US005811760A

United States Patent [19]

Siebelink

[11] Patent Number: 5,811,760

[45] Date of Patent: Sep. 22, 1998

[54] HEATING DEVICE FOR WATER BEDS

[75] Inventor: Willem Siebelink, Zelhem, Netherlands

[73] Assignee: Vontana Wasserbetten GmbH, Oer-Erkenschwick, Germany

[21] Appl. No.: 612,569

[22] Filed: Mar. 8, 1996

[30] Foreign Application Priority Data

Mar. 9, 1995 [DE] Germany ..... 195 08 315.6

[51] Int. Cl.[6] ..... H05B 1/00; H05B 3/34; H05B 3/06; A47C 27/08

[52] U.S. Cl. ..... 219/217; 219/537; 219/528; 5/422

[58] Field of Search ..... 219/217, 536, 219/537, 538, 539, 542, 543, 544; 5/665, 422

[56] References Cited

U.S. PATENT DOCUMENTS

| | | | |
|---|---|---|---|
| 3,790,753 | 2/1974 | Miller | 219/217 |
| 3,982,098 | 9/1976 | Trostler | 219/217 |
| 4,574,184 | 3/1986 | Crews et al. | 219/541 |
| 4,733,056 | 3/1988 | Kojima et al. | 219/543 |
| 4,843,218 | 6/1989 | Husslein et al. | 219/468 |
| 4,922,084 | 5/1990 | Hutter | 219/549 |
| 5,081,339 | 1/1992 | Stine | 219/217 |
| 5,233,166 | 8/1993 | Maeda et al. | 219/543 |

FOREIGN PATENT DOCUMENTS

| | | |
|---|---|---|
| 3224062A1 | 1/1989 | Germany . |
| 3723345A1 | 1/1989 | Germany . |
| 4028354A1 | 3/1991 | Germany . |
| 4102880 | 12/1991 | Germany . |

*Primary Examiner*—Teresa J. Walberg
*Assistant Examiner*—Sam Paik
*Attorney, Agent, or Firm*—Michael J. STriker

[57] ABSTRACT

A heating device for water beds comprises a plurality of electrical resistance conductors arranged between a bed frame and a safety foil, means for controlling the conductors in dependence on the desired temperature of a water core locatable under the safety foil, a plurality of ceramic plates arranged so that the conductors are burnt-in the ceramic plates, a bending resistant metal plate having a lower side, the ceramic plates being glued to the lower side of the metal plate by an adhesive having high thermal conductivity, and a base plate having poor thermal conductivity and placeable on the bed frame, the metal plate being arranged on the base plate in a form-locking manner with an air gap for the ceramic plates.

12 Claims, 5 Drawing Sheets

11
11b
11a
12a
12a
12
V
31
32
V
31
12
30
31
1
1
7
6
8
7

HEATING DEVICE FOR WATER BEDS

BACKGROUND OF THE INVENTION

The present invention relates to a heating device with an electrical resistance conductors for water beds arranged between a bed frame and a safety foil and regulatable in dependence on the desired temperature of a water core located on the safety foil.

Known heating devices of the above mentioned general type include resistance conductors of flexible metal cables surrounded by a synthetic plastic coating and regulated in accordance with the principle of a heating pad. The resistance heaters have the disadvantage of creeping or surface leakage voltage produced by the moisture and air which diffuses in the space between the electric conductor and the embedded plastic material. These "migrations" produce "hot spots" and therefore local overheating and heat accumulation, which finally leads due to an increased energy yield to a burning of the resistance conductors during age fatigue. Since the vinyl of the synthetic plastic coating of the resistance conductor is not compatible with the vinyl of the safety foil, this can lead to displacement of the plasticizers into the safety foil. Finally, these resistance conductors, because of their coil-like heating resistors, are connected with corresponding electromagnetic fields.

SUMMARY OF THE INVENTION

Accordingly, it is an object of the present invention to provide a heating device for water beds, which avoids the disadvantages of the prior art.

More particularly, it is an object of the present invention to provide a heating device for water beds which operates in an energy saving way and excludes hot spots, heat accumulation and plasticizer displacements because of a considerably improved heat transfer with increased safety.

In keeping with these objects and with others which will become apparent hereinafter, one feature of the present invention resides, briefly stated, in a heating device for water beds, which has burnt-in ceramic plates provided with electrical conductors and glued with an adhesive of high thermal conductivity on the lower side of a bendable metal plate which is mounted, with maintaining an air gap for the ceramic plate, form-lockingly on a base plate with lower thermal conductivity. Since the electrical conductor is sintered or burnt-in in the ceramic plate, no leakage voltage can occur. The heat transfer is performed from the burnt-in electrical conductor to the ceramic plate, and from it through the adhesive of higher thermal conductivity to the lower side of the bendable metal plate and from its upper side through the safety foil to the water core.

Since the safety foil is in contact with the metal plate, a substantially improved heat transfer is performed in an energy saving manner, since the heat transfer affecting the synthetic plastic casing as in the resistance wire heating devices is dispensed with. Also the plasticizer displacements are excluded. In view of the bending strength of the metal plate, the whole current conductor is located in the protected arrangement between the lower side of the metal plate and the base plate. Since the coil-like resistors are no longer provided, no significant electric fields can generate. Since the electrical conductors are burnt-in in the ceramic plate, instead of being coated by synthetic plastic material as in conventional resistance heaters, which synthetic plastic has ten times worse thermal conductivity than metals, the inventive heating device ensures a substantially faster and more efficient heating of the water core.

In accordance with an advantageous feature of the present invention, the electric conductor is composed of a pasteous mixture of particles of novel metals, such as gold, silver or ruthenium, as well as ceramic components, such as glass or aluminum oxides, which are burnt-in substantially at 900° C. in the ceramic plates to form a hybrid conductor loop. The adhesive has a poor electrical conductivity, however a high adhesive force and flexibility and is composed of a special silicon mixture. Because of the hybrid mixture of the conductor which contains both metallic conductor material as well as ceramic components of the burnt-in ceramic, it is connected by means of a burnt-in process to provide an intimate heat conductive contact with the ceramic plate.

In accordance with an especially advantageous embodiment of the present invention, several ceramic plates which simultaneously heat the bendable metal plates, are glued in a symmetric arrangement on the lower side, and the electrical conductor of each ceramic plate is connected through flexible, electrical silicon insulating wire conductor with a PCB plate (printed circuit board) arranged between the ceramic plates and provided with printed current conductors, the connection is performed in a parallel connection. The number of the required ceramic plates depends on their size as well as on the size of the metal plate to be heated. The symmetrical arrangement is formed so that each ceramic plate has its own heating region which smoothly merges into the heating region of a neighboring ceramic plate so that in the stationary condition the heated metal plate have no noticeable temperature differences on the outer surface of the metal plate. In other words, on the outer surface of the metal plate only a very low waviness of the heat transfer can be determined. The PCB plate is located between the symmetrically arranged ceramic plate so that a voltage pick up is performed in a shortest way between the burnt-in electrical conductors of the ceramic plates and the printed current conductors.

Advantageously, the current conductors of the printed circuit board are connected with the conventional voltage source through a flexible conductor cable mounted on an end of the lower side of the bendable metal plate, as well as through a conventional plug of the control device actuatable by hand. Thereby the personnel safety is maintained and the flexible conductor cable obtains a massive protection, because of its mounting on the lower side of the bendable metal plate, at its critical connecting point from the conventional permanent pressure forces caused by the water core. Due to the water core, they can act not only statically, but also dynamically during loading.

In order to protect the inventive heating device as well as the water bed from damages during substantial voltage fluctuations in public current system, a safety element is provided at the input of the conductor cable in the electrical printed circuit board. In the event of excessively high temperatures, for example over 70° C., at the lower side of the metal plate or in the event of excessively high voltage in the public current system, the current circuit between the conductor cable and the current conductors of the printed circuit boards is interrupted.

In accordance with still a further feature of the present invention, in order to provide an especially efficient energy-saving heating, the current conductor of the printed circuit board is connected with a relay in form of a triac which is also mounted on the lower side of the metal plate and connected with the control device. Such relays in known heating devices were arranged in the control device located outside the water bed to be easily accessible by the user. Since these relays produce a not insignificant heat radiation, it is utilized, because of the arrangement of a triac on the lower side of the metal plate, also for heating of the water bed.

It is further advantageous to arrange at the lower side of the bending resistant metal plate, an NTC sensor (negative temperature coefficient sensor) which is also connected with the control device. The NTC sensor has such an action that with increasing heating its resistance decreases. Thereby, a reliable control of the heating power transfer at lower temperature differences is guaranteed.

The bending resistant metal plate is composed advantageously of an aluminum alloy having high thermal conductivity, and similarly the bending resistant base plate is composed of a heat resistant synthetic plastic material such as BS, polyurethane, polyamide or polyethylene, for example polytetrafluoroethylene. For avoiding radiation losses through the base plate, it is provided with a heat radiation reflecting layer on its surface facing toward the lower side of the metal plate. The layer can be formed as an evaporated chromium layer or an adhering aluminum foil.

In order to minimize radiation losses, the base plate can be provided at one end with a recess for passage of the electric conductor cable, and under each ceramic plate as well as under the printed circuit board with recesses for these parts. They have such a depth that after the form-locking placement of the metal plate, all heat conductive metal and ceramic parts have an air gap at least 2 mm relative to the base plate.

For avoiding damages to the safety foil with simultaneous substantial heat transfer of the metal plate to the water core, both the bending resistant metal plate as well as the base plate are rounded in their corner regions and form together a very flat, plate-shaped frustrated cone without projecting regions. It is also possible to arrange the heating device in a projection of the bed frame so that the upper surface of the metal plate is in alignment with the surrounding surface of the bed frame.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
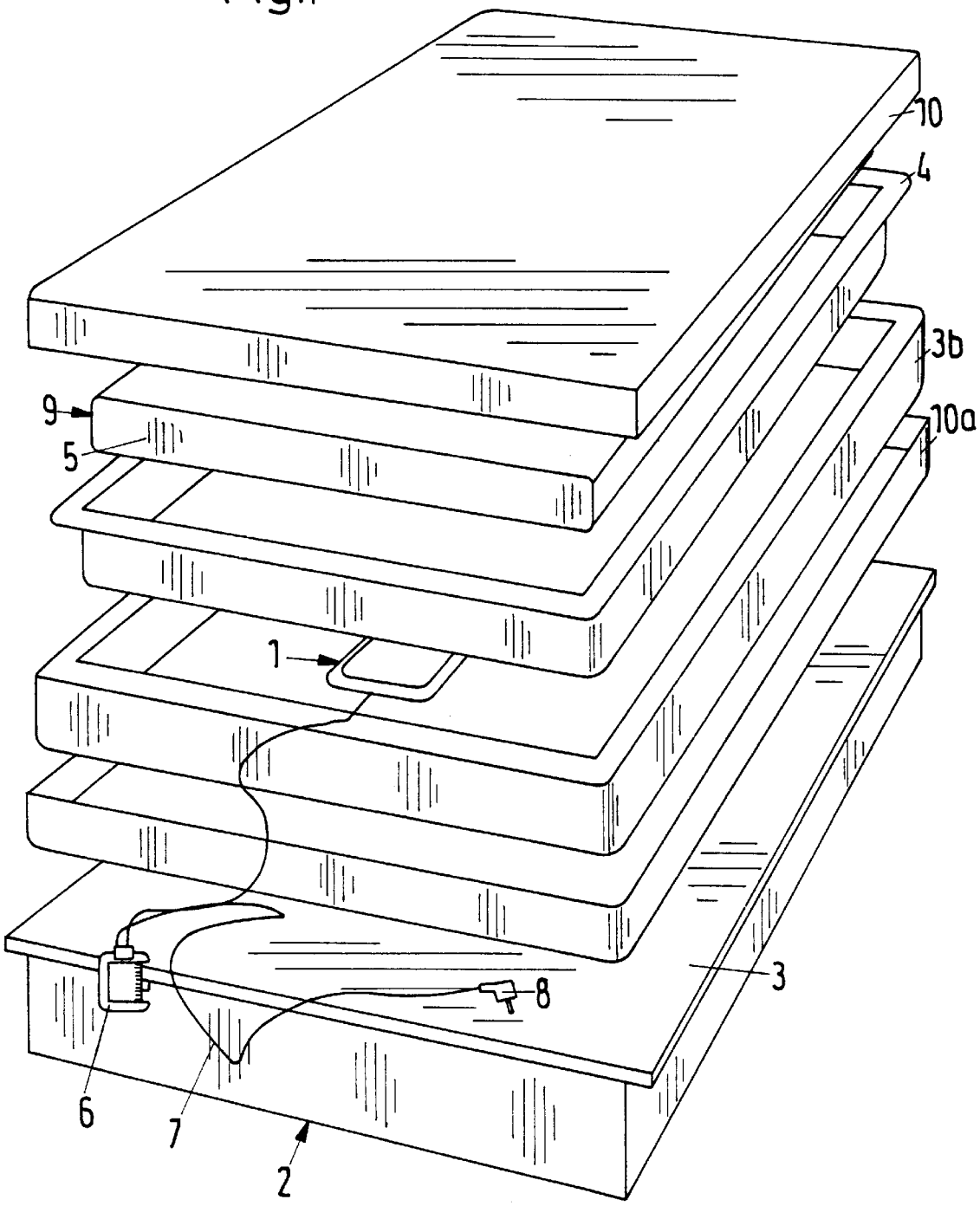
FIG. 1 is a perspective exploded view of a water bed with a heating device arranged between a bed frame and a safety foil.

A new heating device is identified with reference numeral 1 and provided for a water bed 2. It is arranged between a bed frame 3 and a safety foil 4. The device is controlled in dependence on the desired temperature of a water core 5 located on the safety foil 4 by a control device 6. The control unit 6 is actuatable manually and located outside. The control unit 6 is connectable via a flexible conductor cable 7 with the heating device 1 on the one hand and is also connectable through a conventional plug 8 with a household voltage source in form of a socket.

Figure 2:
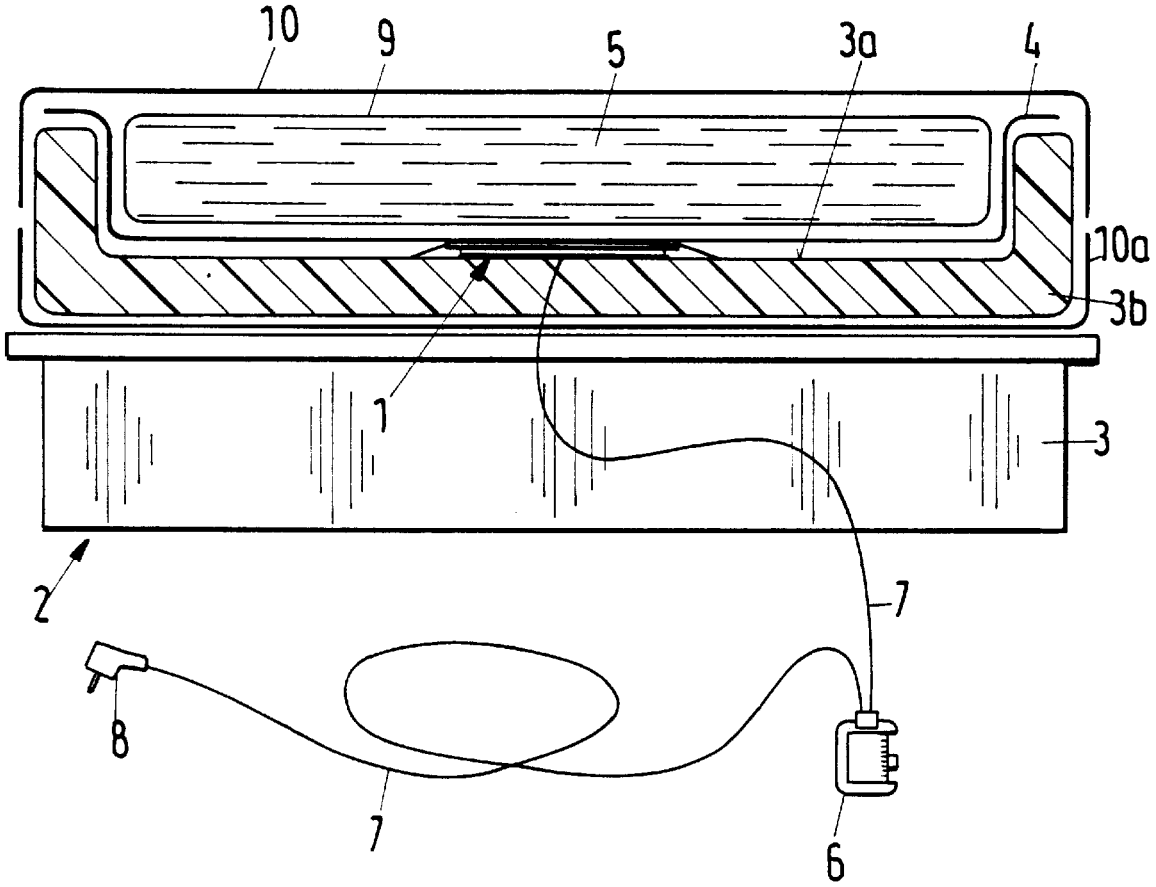
FIG. 2 is a view showing a cross-section through the water bed with a heating device arranged between the bed frame and the safety foil of FIG. 1.
Figure 3:
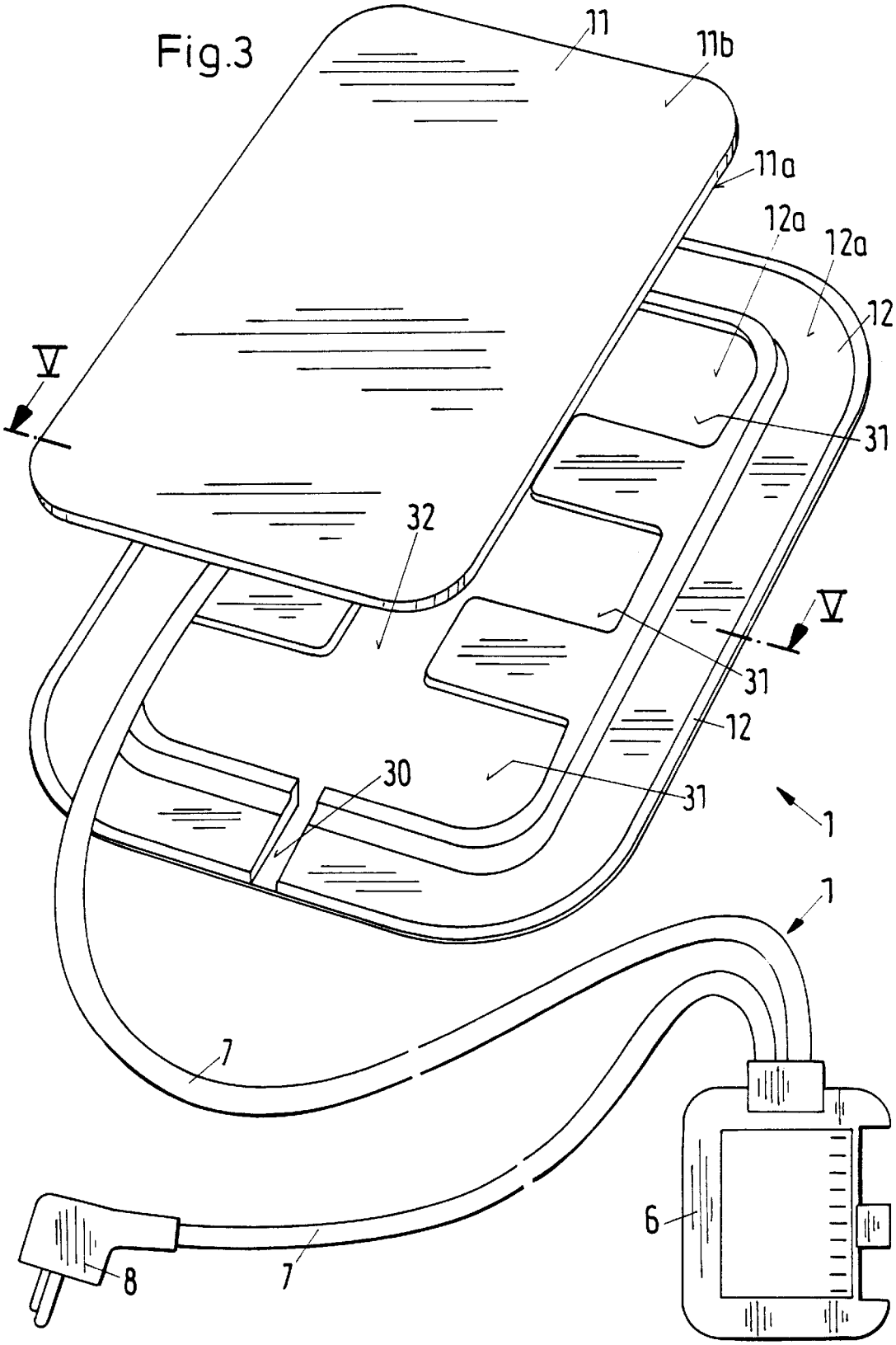
FIG. 3 is a perspective exploded view of the heating device composed of a metal plate, a base plate and a control device.

As can be seen from FIGS. 1 and 2, the water core 5 is enclosed by a sleeve 9 composed of synthetic material and overlapped by a cover 10.

The heating device 1 shown in FIGS. 3–6 includes a bending resistant metal plate having a high thermal conductivity, which is placed with its lower side 11*a* in form-locking manner on a base plate 12 having lower thermal conductivity on the bed frame 3 or a recess provided in it. Heat is transferred from the upper side 11*b* of the metal plate 11 through the safety foil 4 and further through a synthetic plastic envelope 9 on the water core 5. Water is heated by natural convection of the water core 5 in connection with induced water movements inside the envelope 9 during loading of the water core 5.

Figure 4:
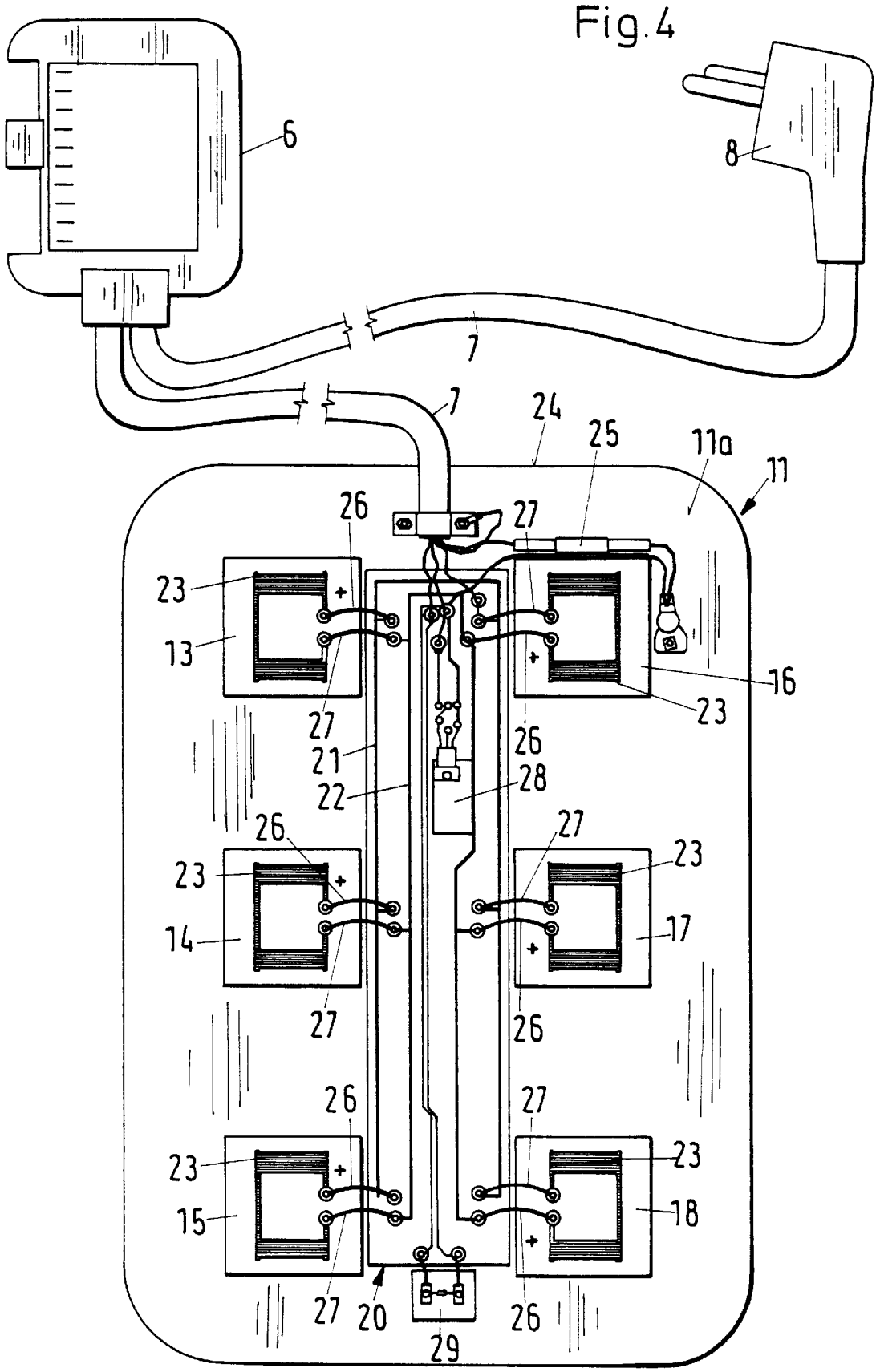
FIG. 4 is a view showing a lower side of the metal plate illustrated in FIG. 3.
Figure 5:
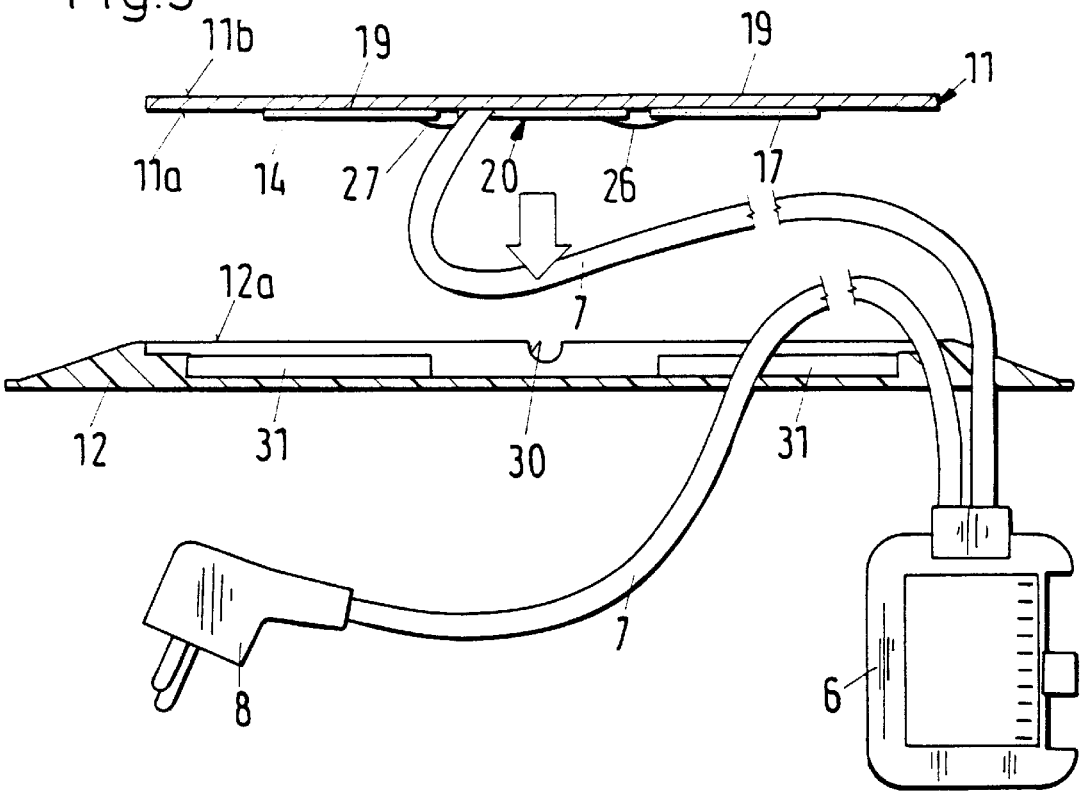
FIG. 5 is a view showing a section taken along the line V—V in FIG. 3.
Figure 6:
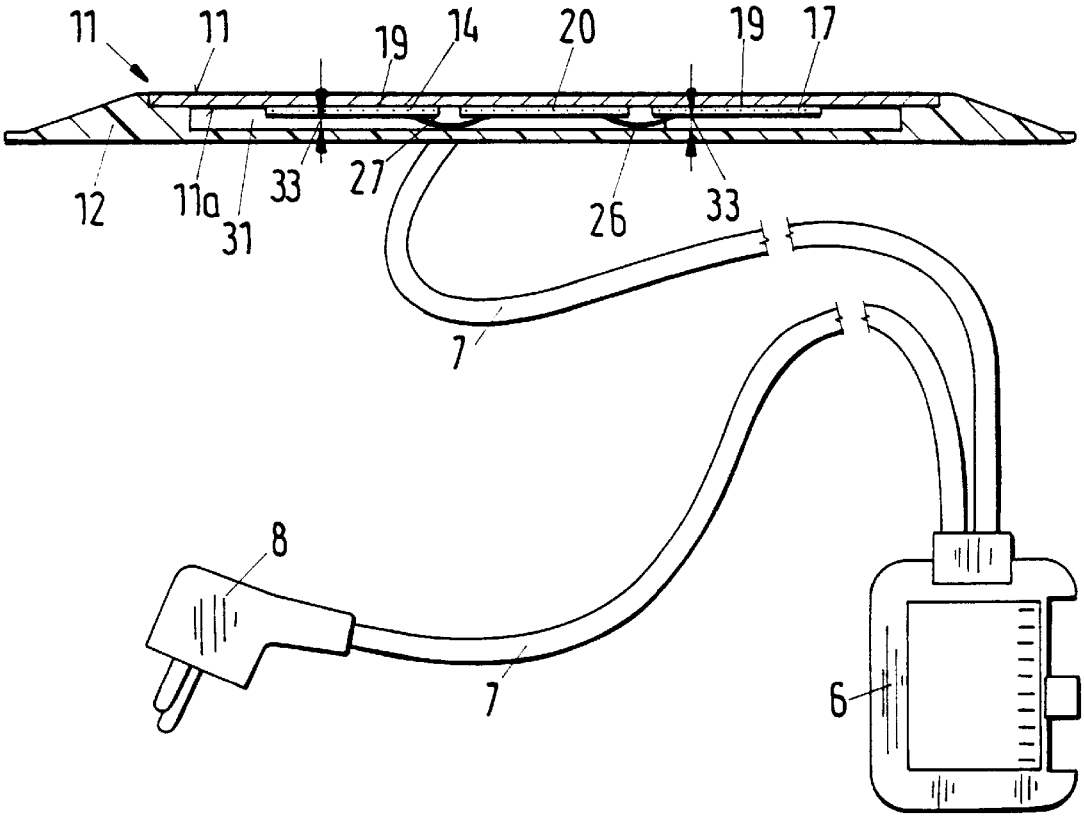
FIG. 6 is a view of FIG. 5 after placing of the metal plate on the base plate.

As can be seen from FIGS. 4–6, six ceramic plates 13–18 are arranged on the lower side 11*a* of the metal plate 11 in a symmetrical arrangement by an adhesive 19 shown in FIG. 5 with high thermal conductivity. The adhesive 19 has a poor electrical conductivity, however, it has a high adhesive force and flexibility and is composed of a silicon mixture. A PCB plate 20 or printed circuit board provided with printed current conductors 21 and 22 glued between both symmetrical rows 13–15 and 16–18 of the ceramic plates 13–18 on the lower side 11*a* of the metal plate 11.

Each ceramic plate is provided with a burnt-in, electrical conductors 23 composed of a pasteous mixture of particles of noble metals, such as gold, silver or ruthenium, as well as ceramic components such as glass and aluminum oxide, which at substantially 900° C. are burnt-in the ceramic plates 13–18 to form a hybrid conductor loop. The current conductors 21, 22 of the printed circuit board 20 are connected with a conventional plug 8 via a flexible conductor cable 7 mounted on an end 24 on the lower side 11*a* of the metal plate 11, through the control unit 6. A safety element 25 is provided on the input of the conductor cable 7 in the electrical printed circuit board 20. At excessively high temperatures, for example 70° C., on the lower side 11*a* of metal plate or excessively high voltage and thereby excessive current supply, the current circuit between the conductor cable 7 and the current conductors 21, 22 of the printed circuit board 20 is interrupted. Each electrical conductor 23 of the ceramic plates 13–18 is connected through a flexible, electric and silicon insulated wire conductor 26, 27 with the printed current conductors 21, 22 all conductors 23 are arranged in a parallel connection.

The current conductors 21, 22 of the printed circuit board 20 are connected with a relay 28 in form of a triac. They are also mounted on the lower side 11*a* of the metal plate 11 and connected with the control unit 6.

Finally, an NTC sensor (negative temperature coefficient sensor) 29 is arranged on the lower side 11*a* of the metal plate 11 and is also connected with the control unit 6. Due to the arrangement of the relay 28 in form of the triac as well as the NTC sensor 29 on the lower side of the metal plate 11, these heat radiating control parts are also utilized in an elegant way for heating the water bed, whereby the control unit 6 performs the function of a switch which is not affected by any significant heat radiation.

The bending resistant metal plate 11 is composed advantageously of an aluminum alloy with high thermal conductivity, and the bending resistant base plate 12 is composed of a heat resistant synthetic plastic material, such as BC, polyurethane, polyamide, or polyethylene with poor thermal conductivity. Since aluminum alloys have a six-eight times higher thermal conductivity number λ than steel, they are especially suitable for the use as heat transmitting surfaces.

The base plate 12 to the contrary performs the function of a bending resistant supporting construction as well as a heat damper. For directing the vector of the heat transmission deliberately in direction toward the water core 5, the base plate 12 is provided at its face 12*a* which faces the lower side 11*a* of the metal plate 11 with a layer which reflects a thermal radiation. For example this layer is a chromium coating or aluminum foil. Moreover, the base plate 12 at its upper surface side 12*a* has at one end a recess 30 for passage of the conductor cable 7, and underneath each ceramic plate 13–18 has recesses 31 as well as a central recess 32 for the printed circuit board 20. These recesses 31, 32 are formed so that after the form-locking placement of the metal plate 11 on the base plate 12 all heat conductive metal and ceramic parts 13–18, 20–23, 25–29 are arranged with an air gap 33 (see FIG. 6) of at least 2 mm relative to the upper surface 12*a* of the base plate 12. Since air in view of its poor thermal conductivity is a pronounced thermal damper a thermal radiation of the metal plate in an undesired direction away from the water core 5 is interrupted this way in a simple manner.

As can be seen from FIG. 6, both the bending resistant metal plate 11 as well as the base plate 12 are rounded in their corner regions and together form a very flat, plate-shaped truncated cone without projections so that they can be inserted in a flat recess of the bed supporting surface 3*a* to align the upper surface 11*b* of the metal plate 11 with the bed supporting surface 3*a*.

With the inventive heating device 11 it is possible to obtain a temperature between 29° C. and 40° C. on the upper surface 11*b* of the metal plate 11, which substantially corresponds to the temperature on the lower side 11*a* of the metal plate 11. With this temperature region, the water core 5 can be heated to a skin temperature on the outer surface of the envelope 9 of 27° C.–36° C. At the lower side of the base plate 12, then also a temperature in the same region, namely between 27° C. and 36° C. is available. Since the temperature on the lower side of the base plate 12 is equal to the temperature on the upper side of the envelope 9, additional radiation losses due to an increased temperature difference as in the resistance wire heating devices of the prior art, are eliminated.

It will be understood that each of the elements described above, or two or more together, may also find a useful application in other types of constructions differing from the types described above.

While the invention has been illustrated and described as embodied in a heating device for water beds, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A heating device for water beds, comprising a plurality of electrical resistance conductors arranged between a bed frame and a safety foil; means for controlling said conductors in dependence on the desired temperature of a water core locatable under the safety foil; a plurality of ceramic plates arranged so that said conductors are burnt-in said ceramic plates; a bending resistant metal plate having a lower side, said ceramic plates being glued to said lower side of said metal plate by an adhesive having high thermal conductivity; and a base plate having poor thermal conductivity and placeable on the bed frame, said metal plate being arranged on said base plate in a form-locking manner with an air gap for said ceramic plates.

2. A heating device as defined in claim 1, wherein said electrical conductors are composed of a pasteous mixture of particles of a noble metal selected from the group consisting of gold, silver and ruthenium, and a ceramic component selected from the group consisting of glass and aluminum oxide, said electrical conductors being burnt-in said ceramic plates substantially at a temperature of 900° C. so as to form a hybrid conductor loop.

3. A heating device as defined in claim 1, wherein said adhesive is composed of a silicon mixture having a low electrical conductivity, a high adhesive force and a high flexibility.

4. A heating device as defined in claim 1; and further comprising a negative temperature coefficient sensor arranged on said lower side of said metal plate and connected with said control means.

5. A heating device as defined in claim 1, wherein said metal plate is composed of an aluminum alloy with high thermal conductivity, said base plate being composed of a heat resistant synthetic plastic material having low thermal conductivity and selected from the group consisting of ABS, polyurethane, polyamide and polyethylene.

6. A heating device as defined in claim 1, wherein said base plate has a surface facing said lower side of said metal plate and is provided on said surface with a layer reflecting a thermal radiation.

7. A heating device as defined in claim 1, wherein said metal plate and said base plate are rounded in corner regions and together form a flat, plate-shaped truncated cone without projecting regions.

8. A heating device for water beds, comprising a plurality of electrical resistance conductors arranged between a bed frame and a safety foil; means for controlling said conductors in dependence on the desired temperature of a water core locatable under the safety foil; a plurality of ceramic plates arranged so that said conductors are burnt-in said ceramic plates; a bending resistant metal plate having a lower side, said ceramic plates being glued to said lower side of said metal plate by an adhesive having high thermal conductivity; and a base plate having poor thermal conductivity and placeable on the bed frame, said metal plate being arranged on said base plate in a form-locking manner with an air gap for said ceramic plates, said ceramic plates uniformly heating said metal plate and glued in a symmetrical arrangement on said lower side; and a printed circuit board located between said ceramic plates and provided with printed current conductors, said electrical conductors of said ceramic plates being connected through flexible, electrical silicon insulated wire conductors with said printed circuit board in a parallel circuit.

9. A heating device as defined in claim 8; and further comprising a flexible conductor cable mounted on said lower side of said metal plate; and a conventional plug, said control means including a control unit, said current conductors of said printed circuit board are connectable through said conductor cable as well as through said control unit via said plug with a household voltage source.

10. A heating device as defined in claim 9; and further comprising a safety element arranged at the input of said conductor cable in said electrical printed circuit board, said safety element in the event of excessively high temperatures at said lower side of said metal plate and in the event of excessively high voltage of a current circuit composed of said conductor cable, said current conductors, said electrical conductors, and said wire conductors, interrupts an electrical connection between said conductor cable and said current conductors of said printed circuit board.

11. A heating device as defined in claim 8; and further comprising a relay, said current conductors of said printed circuit board being connected with said relay in form of a triac, said relay being also mounted on said lower side of said metal plate and connected with said control means.

12. A heating device as defined in claim 9, wherein said base plate is provided at one end with a recess for passage of said electrical conductor cable and under each ceramic plate and under printed circuit board is provided with recesses for said ceramic plates and under said printed circuit board with a depth such that after a form-locking placement of said metal plate all heat conductive metal and ceramic parts are arranged with an air gap of at least 2 mm relative to said base plate.

* * * * *